United States Patent [19]

Schmidt et al.

[11] Patent Number: 4,473,466

[45] Date of Patent: Sep. 25, 1984

[54] FLAT SIEVE ELEMENT

[75] Inventors: Gerhard Schmidt, Ettlingen; Wolfgang Lehmann, Kuppenheim, both of Fed. Rep. of Germany

[73] Assignee: Isenmann Drahterzeugnisse GmbH, Karlsruhe, Fed. Rep. of Germany

[21] Appl. No.: 471,559

[22] Filed: Mar. 2, 1983

[30] Foreign Application Priority Data

Mar. 3, 1982 [DE] Fed. Rep. of Germany ..... 3207581

[51] Int. Cl.[3] ..... B07B 1/49

[52] U.S. Cl. ..... 209/397; 209/403; 210/498

[58] Field of Search ..... 209/393–395, 209/397, 399, 401, 403, 405; 210/498

[56] References Cited

U.S. PATENT DOCUMENTS 4,347,129 8/1982 Rutherford ..... 209/405

FOREIGN PATENT DOCUMENTS 235520 6/1911 Fed. Rep. of Germany ..... 209/393
2634934 10/1978 Fed. Rep. of Germany .
1483217 8/1927 United Kingdom ..... 209/397

*Primary Examiner*—Bernard Nozick
*Attorney, Agent, or Firm*—Karl F. Ross; Herbert Dubno

[57] ABSTRACT

A flat sieve, or a part thereof, has a flat body of elastic material with a rectangular (or square) frame spanned by a plate of lesser depth with a multiplicity of throughgoing parallel slots and intervening rows of shorter slots interrupted by solid transverse webs which are integral with crossbars intersecting only the lower portions of the longer, throughgoing slots. The length of the shorter slots may be about one-tenth that of the longer slots.

10 Claims, 2 Drawing Figures

FLAT SIEVE ELEMENT

CROSS-REFERENCE TO RELATED APPLICATION

This application contains subject matter disclosed in our copending application Ser. No. 317,381 filed Nov. 2, 1981 now abandoned.

FIELD OF THE INVENTION

Our present invention relates to a sieve, or to a part of such sieve, which has a four-sided (preferably rectangular or square) frame whose opening is spanned by a slotted horizontal plate for the sifting of solid particles or the drainage of liquids from a mass placed thereon.

BACKGROUND OF THE INVENTION

A sieve of this type is known, for example, from German printed application No. 2,634,934. In an effort to combine a filtering or drainage area of large relative cross-section with structural stability of the carrier plate, that known sieve has a number of parallel throughgoing slots—extending over substantially the full length of width of the plate—alternating with rows of shorter slots interrupted by solid portions of the plate surface. Our copending application Ser. No. 317,381 now abandoned, whose disclosure is incorporated by reference into the present one, describes and shows a similar sieve element with either partly or fully throughgoing slots separated by ribs whose lower portions are interconnected by crossbars of different height.

Care must be taken in such sieves that solid particles of the mass being filtered or dewatered do not penetrate into the slots and deform the ribs bounding same, especially when the plate spanning the frame is made of elastic or otherwise yieldable material such as polyurethane, for example. Aside from a possible clogging of the slots by particles wedged therein, the resulting local widening thereof impairs the utility of the sieve as a means for the classification of comminuted solids, i.e. for separating particles with sizes above and below a certain threshold from one another.

OBJECT OF THE INVENTION

The object of our present invention, therefore, is to provide an improved sieve element of the general type referred to which combines great structural stability with a relatively large open area for the draining or the filtering of a particulate mass.

SUMMARY OF THE INVENTION

A sieve element according to our invention has a basic structure similar to that disclosed in our copending application Ser. No. 317,381 now abandoned, namely a four-sided horizontal frame integral with a slitted plate spanning its interior in order to support a mass to be drained, filtered or classified, this plate being formed with a multiplicity of ribs defining a plurality of continuous throughgoing slots and intervening rows of shorter slots parallel to a pair of frame sides. In accordance with our present improvement, crossbars perpendicular to the slots underlie transverse webs separating the shorter slots of a row from one another.

Preferably, the ribs have undersides coplanar with those of the crossbars and rise above the latter to the level of the upper surfaces of the transverse webs, thus forming a sturdy grid. Such a carrier plate and its frame can be readily molded in one piece from plastic material which may have a certain elasticity to facilitate the fitting of the sieve element into a larger mounting frame.

BRIEF DESCRIPTION OF THE DRAWING

The above and other features of our present invention will now be described in detail with reference to the accompanying drawing in which.

SPECIFIC DESCRIPTION

Figure 1:
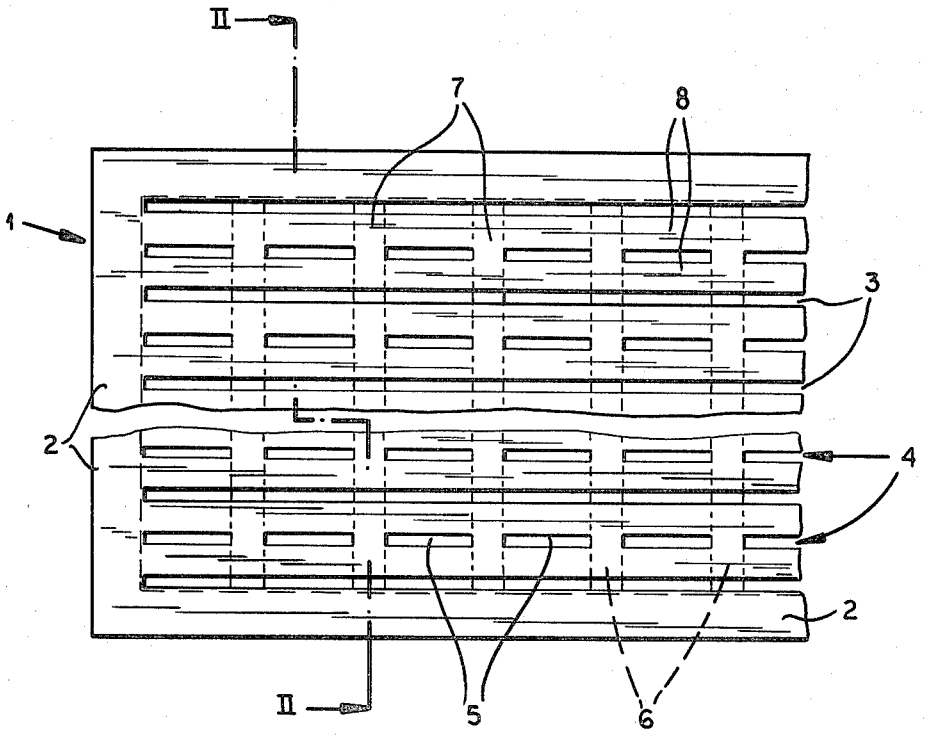
FIG. 1 is a top view of a representative portion of a sieve element embodying our invention.
Figure 2:
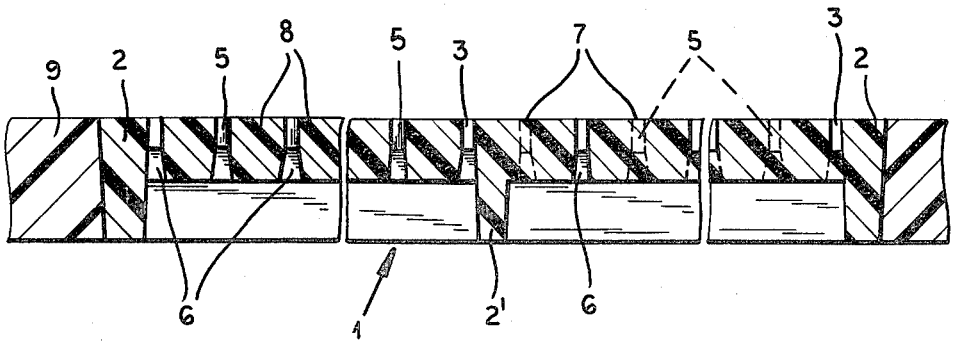
FIG. 2 is a cross-sectional view taken on the line II—II of FIG. 1.

As shown in the drawing, a sieve element 1 according to our invention comprises a rectangular frame 2 whose opening is spanned by a horizontal carrier plate forming a multiplicity of parallel ribs 8 which together with two frame sides define continuous throughgoing slots 3 and rows 4 of shorter slots 5. The shorter slots 5 of any row are separated by transverse webs 7 which terminate at the longer slots 3 and directly overlie respective crossbars 6 intersecting the throughgoing slots 3 only in the lower half of their cross-section. As will be apparent from FIG. 2, the carrier plate consisting of members 6, 7 and 8 lies only in the upper half of frame 2 and is molded integral therewith from plastic material; a middle rib', however, extends over the full height of the frame. Molding is facilitated by a downward tapering of all the ribs, and of the strips defining the frame 2, in the region below the upper level of crossbars 6; these crossbars may be similarly tapered. FIG. 2 further shows that the sieve element 1 is fitted into a larger mounting frame 9 which could have a number of rectangular cutouts receiving several such sieve elements. With the upper surfaces of frames 2 and 9 as well as those of ribs 8 and webs 7 all lying in a common horizontal plane, the goods to be treated can be readily spread over all the sieve elements.

We prefer to make the length of each of the shorter slots 5 equal to about one-tenth the length of the slots 3, even though that length ratio may range more generally between approximately 1:5 and 1:20. Thus, for example, slots 3 may have a length of 120 mm while each slot 5 is 12 mm long. Both sets of slots should have the same width, e.g. 0.5 mm in a specific instance. The width of the webs 7 and the crossbars 6 should be a small fraction of the length of slots 5, e.g. about a third thereof as shown.

We claim:

1. A flat sieve element comprising a four-sided horizontal frame and a carrier plate integral with said frame spanning the interior thereof, said plate being formed with a plurality of continuous throughgoing long slots and intervening rows of shorter slots all parallel to two frame sides, said shorter slots being interrupted by solid transverse webs rigid with ribs parallel to said frame sides separating said throughgoing slots and said rows of shorter slots from one another, said webs terminating at said long slots and being underlain by crossbars spanning said two frame sides.

2. A sieve element as defined in claim 1 wherein said frame and said plate consist of elastic material.

3. A sieve element as defined in claim 1 wherein said plate has a height less than that of said frame.

4. A sieve element as defined in claim 1 wherein said crossbars have undersides flush with those of said ribs and intersect said throughgoing slots at a level below that of said webs.

5. A sieve element as defined in claim 4 wherein said frame, said webs and said ribs have coplanar upper surfaces.

6. A sieve element as defined in claim 2 wherein the width of said webs and ribs in the longitudinal direction of said slots is a minor fraction of the length of said shorter slots.

7. A sieve element as defined in claim 4 wherein said shorter slots have a length ranging between about one-fifth and one-twentieth that of said throughgoing slots.

8. A sieve element as defined in claim 5 wherein the length of said shorter slots is approximately one-tenth that of said throughgoing slots.

9. A sieve element as defined in claim 1 wherein said throughgoing slots and said shorter slots are of identical width.

10. A sieve element as defined in claim 7 wherein the width of said slots is on the order of 0.5 mm.

* * * * *